US005687528A

United States Patent [19]

Rouch

[11] Patent Number: 5,687,528

[45] Date of Patent: Nov. 18, 1997

[54] PATCH FASTENER DEVICE FOR A PLASTERBOARD WALL

[76] Inventor: Duane A. Rouch, 176 Daly Rd., East Northport, N.Y. 11731

[21] Appl. No.: 645,526

[22] Filed: May 14, 1996

[51] Int. Cl.[6] ..... E04G 23/02

[52] U.S. Cl. ..... 52/514; 52/514.5

[58] Field of Search ..... 52/514, 514.5, 52/509, 512, 506.05, 418, 419

[56] References Cited

U.S. PATENT DOCUMENTS

| | | | |
|---|---|---|---|
| 4,510,728 | 4/1985 | Key | 52/514 |
| 4,620,407 | 11/1986 | Schmid | 52/514 X |
| 4,641,474 | 2/1987 | Cannarsa | 52/514 |
| 4,782,642 | 11/1988 | Conville | 52/514 X |
| 4,989,385 | 2/1991 | McCullough | 52/514 |
| 4,995,605 | 2/1991 | Conville | 52/514 X |
| 5,079,888 | 1/1992 | Hileman et al. | 52/514 |
| 5,269,861 | 12/1993 | Gilbreath | 52/514 X |
| 5,299,404 | 4/1994 | Jabro | 52/514 |
| 5,556,688 | 9/1996 | Cox | 52/514 X |

*Primary Examiner*—Carl D. Friedman
*Assistant Examiner*—Beth A. Aubrey
*Attorney, Agent, or Firm*—Michael I. Kroll

[57] ABSTRACT

A patch fastener device (10) for a plasterboard wall (12) comprising a first flat segment (14). A second flat segment (16) extends upwardly from a side of the first flat segment (14). The second flat segment (16) has a width of approximate thickness of the plasterboard wall (12). A third flat segment (18) extends outwardly from a side of the second flat segment (16) opposite to that of the first flat segment (14). A first facility (20) is on a top surface of the first flat segment (14), for securing the first flat segment (14) to a rear surface (22) of a plasterboard patch (24). A second facility (26) is on a bottom surface of the third flat segment (18), for securing the third flat segment (18) to a front surface (28) of the plasterboard wall (12), when the plasterboard patch (24) is inserted into a matching cutout hole (30) in the plasterboard wall (12).

1 Claim, 2 Drawing Sheets

PATCH FASTENER DEVICE FOR A PLASTERBOARD WALL

BACKGROUND OF THE INVENTION

1. Field of the Invention

The instant invention relates generally to plasterboard repair equipment and more specifically it relates to a patch fastener device for a plasterboard wall.

2. Description of the Prior Art

Numerous plasterboard repair equipment have been provided in prior art that are utilized to fix cracks, holes and loose plaster in plasterboard walls. While these units may be suitable for the particular purpose to which they address, they would not be as suitable for the purposes of the present invention as heretofore described.

SUMMARY OF THE INVENTION

A primary object of the present invention is to provide a patch fastener device for a plasterboard wall that will overcome the shortcomings of the prior art devices.

Another object is to provide a patch fastener device for a plasterboard wall, in which two devices are used in conjunction for supporting a plasterboard patch in a matching cutout hole in the plasterboard wall, so that a plaster compound can be safely applied over the patch and surrounding area of the plasterboard wall to produce a smooth cosmetic appearance thereto.

An additional object is to provide a patch fastener device for a plasterboard, in which peel away adhesive strips on each of the two devices will support any sized plasterboard patch and not be intrusive to the surrounding area of plasterboard wall being repaired.

A further object is to provide a patch fastener device for a plasterboard wall that is simple and easy to use.

A still further object is to provide a patch fastener device for a plasterboard wall that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 2:
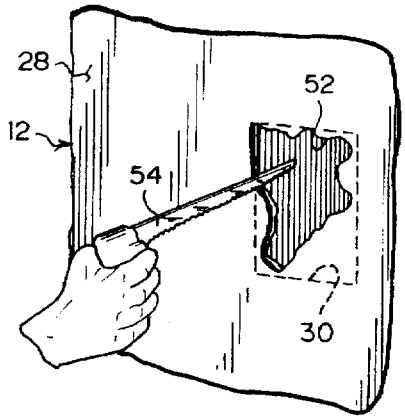
FIG. 2 is a perspective view showing a hand of a person using a keyhole saw to evenly cutout the hole in the plasterboard wall.
Figure 2A:
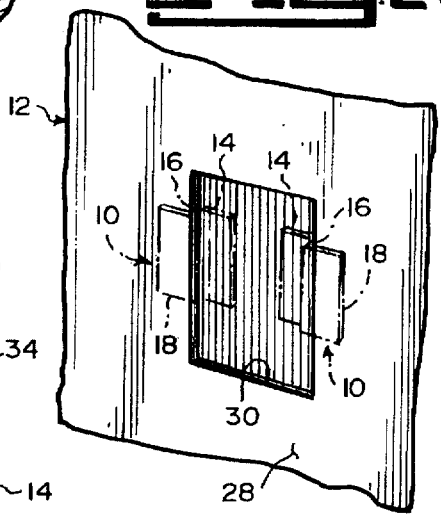

FIG. 2*a* is a perspective view of the plasterboard wall with the cutout hole showing in phantom two of the devices in place.

Figure 3:
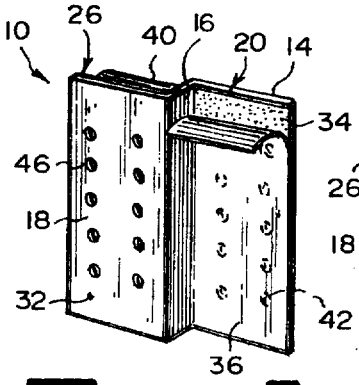

FIG. 3 is an enlarged perspective view of the instant invention per se with plaster compound adhering apertures therein.

Figure 3A:
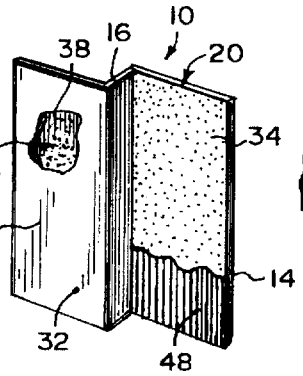

FIG. 3*a* is an enlarged perspective view similar to FIG. 3 without the plaster compound adhering apertures.

Figure 5:
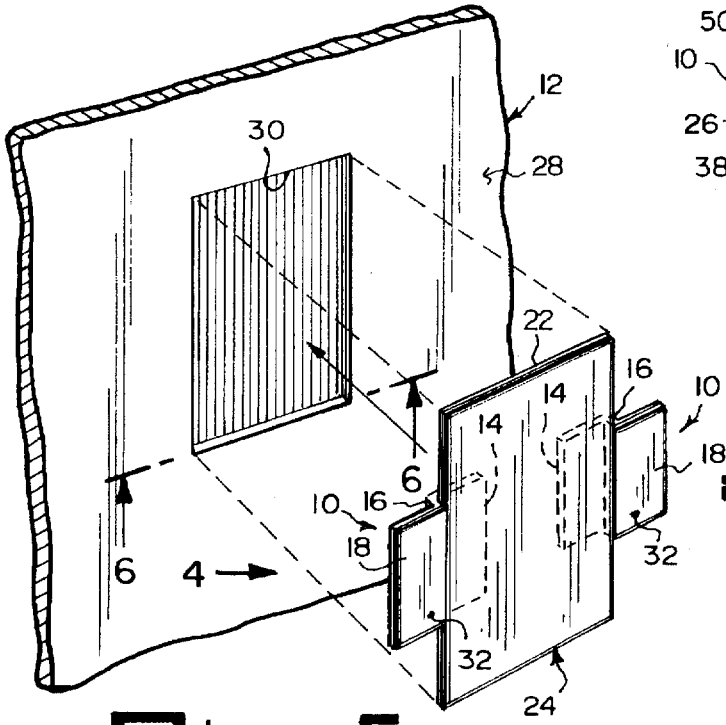
Figure 4:
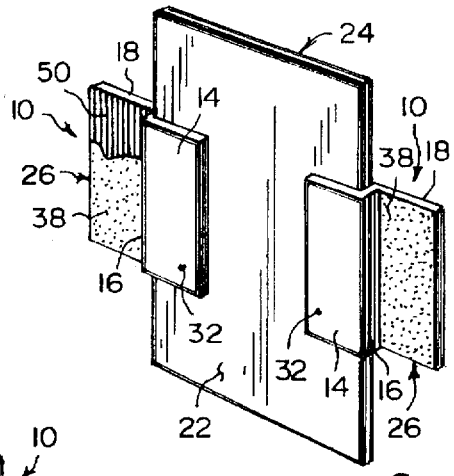

FIG. 4 is a rear perspective view taken in the direction of arrow 4 in FIG. 5 of the plasterboard patch with two of the devices attached to opposite sides thereof.

FIG. 5 is a perspective view of the plasterboard wall with the cutout hole and the matching plasterboard patch with two of the devices exploded therefrom.

Figure 6:
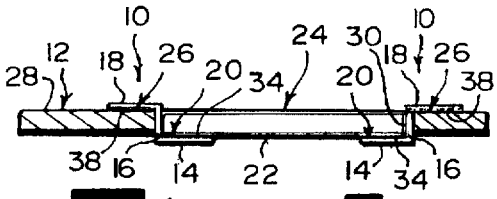

FIG. 6 is a cross sectional view taken along line 6—6 in FIG. 5 with the plasterboard patch and the two devices inserted in place.

Figure 7:
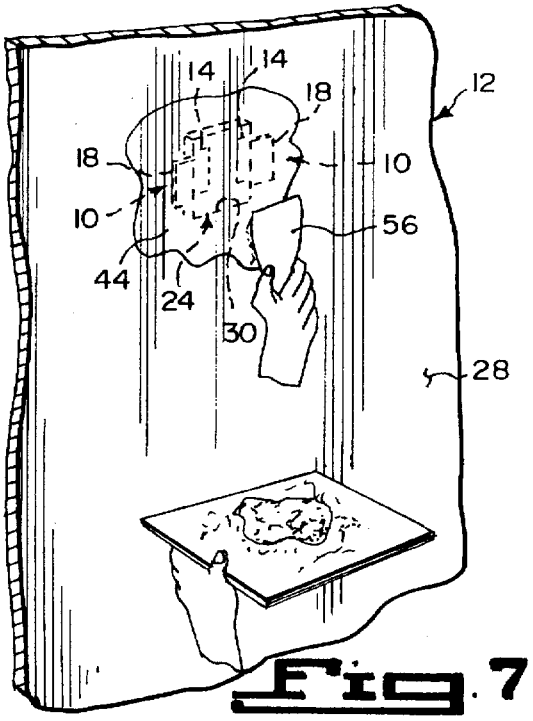

FIG. 7 is a perspective view of the plasterboard wall showing a plaster compound being applied over the patch.

Figure 8:
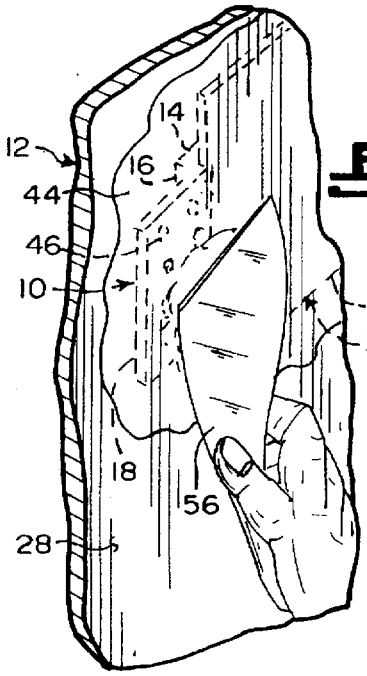

FIG. 8 is an enlarged perspective view of the plasterboard wall similar to FIG. 7, showing in greater detail the plaster compound being applied over the patch and especially the plaster compound adhering apertures in the device.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 2*a* through 8 illustrate a patch fastener device 10 for a plasterboard wall 12 comprising a first flat segment 14. A second flat segment 16 extends upwardly from a side of the first flat segment 14. The second flat segment 16 has a width of approximate thickness of the plasterboard wall 12. A third flat segment 18 extends outwardly from a side of the second flat segment 16 opposite to that of the first flat segment 14.

A first facility 20 is on a top surface of the first flat segment 14 for securing the first flat segment 14 to a rear surface 22 of a plasterboard patch 24. A second facility 26 is on a bottom surface of the third flat segment 18, for securing the third flat segment 18 to a front surface 28 of the plasterboard wall 12, when the plasterboard patch 24 is inserted into a matching cutout hole 30 in the plasterboard wall 12.

The first flat segment 14, the second flat segment 16 and the third flat segment 18 are integral and formed by stamping and bending. The first flat segment 14, the second flat segment 16 and the third flat segment 18 are manufactured from a thin material 32 selected from a group consisting of sheet metal, aluminum, galvanized steel and plastic. The second flat segment 16 is substantially perpendicular to the first flat segment 14 and the third flat segment 18.

The first securing facility 20 includes a first double sided adhesive tape 34 applied to the top surface of the first flat segment 14, so that it can be pressed against the rear surface 22 of the plasterboard patch 24 and stick thereto. A first protective cover strip 36 is on the first double sided adhesive tape 34. When the first protective cover strip 36 is peeled away, the first double sided adhesive tape 34 will be exposed.

The second securing facility 26 consists of a second double sided adhesive tape 38 applied to the bottom surface of the third flat segment 18, so that it can be pressed against the front surface 28 of the plasterboard wall 12 adjacent the side of the cutout hole 30 and stick thereto. A second protective cover strip 40 is on the second double sided adhesive tape 38. When the second protective cover strip 40 is peeled away, the second double sided adhesive tape 38 will be exposed.

The first double sided adhesive tape 34 can be substituted with glue applied at a factory. The second double sided adhesive tape 38 can also be substituted with glue applied at the factory, which makes the patch fastener devices 10.

As shown in FIGS. 3 and 8, the first flat segment 14 can have a plurality of small apertures 42 therethrough, so that a plaster compound 44 can better adhere thereto. The third flat segment 18 can also have a plurality of small apertures 46 therethrough, so that the plaster compound 44 can better adhere thereto.

As shown in FIG. 3*a*, the first flat segment 14 can also have a rough texture 48 on the top surface thereof, so that the plaster compound 44 can better adhere thereto. In FIG. 4, the third flat segment 18 can also have a rough texture 50 on the bottom surface thereof, so that the plaster compound 44 can better adhere thereto.

Operation of the Invention

Figure 1:
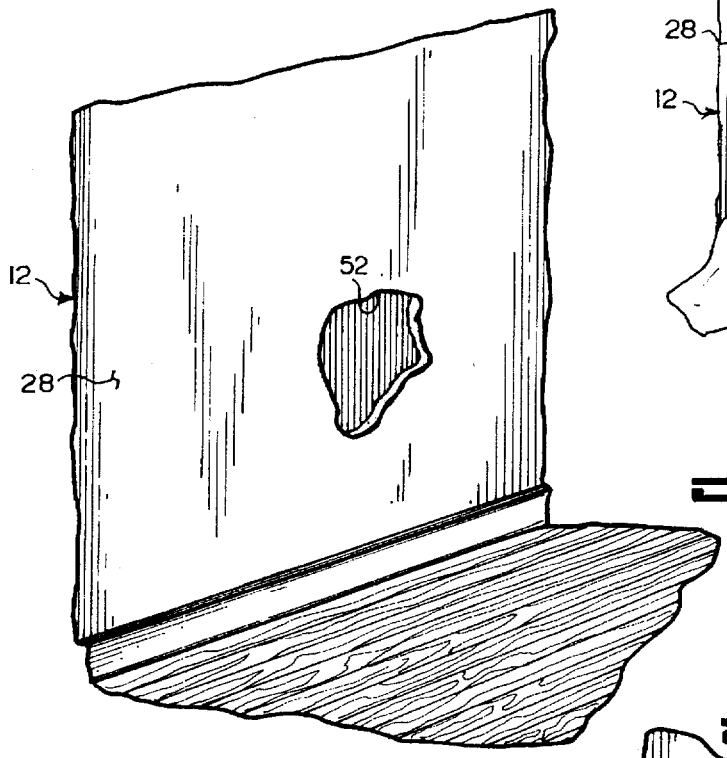
FIG. 1 is a perspective view of a portion of a plasterboard wall having an irregular hole therein.

To use the patch fastener device 10, the following steps should be taken:

1. Remove an area about an irregular hole 52 of the plasterboard wall 12 with a keyhole saw 54 by making the cutout hole 30 (see FIGS. 1 and 2).
2. Prepare the plasterboard patch 24, so that it will substantially match and fit within the cutout hole 30 in the plasterboard wall 12 (see FIG. 5).
3. Peel away the first protective cover 36 to expose the first double sided adhesive tape 34 on a first patch fastener device 10.
4. Press the first double sided adhesive tape 34 against the rear surface 22 on the plasterboard patch 24 at a first side thereof.
5. Peel away the first protective cover 36 to expose the first double sided adhesive tape 34 on a second patch fastener device 10.
6. Press the first double sided adhesive tape 34 against the rear surface 22 on the plasterboard patch 24 at a second opposite side thereof.
7. Remove the second protective covers 40 to expose the second double sided adhesive tapes 38 on the first and second patch fastener devices 10 (see FIG. 4).
8. Insert the plasterboard patch 24 into the cutout hole 30 in the plasterboard wall 12, so that the second double sided adhesive tapes 38 on the first and second patch fastener devices 10 will stick to the front surface 20 of the plasterboard wall 12 (see FIG. 6).
9. Apply the plaster compound 44 with a putty knife 56 over the plasterboard patch 24, the two patch fastener devices 10 and spackle tape on the surrounding areas of the plasterboard wall 12 until a smooth cosmetic appearance is achieved (see FIGS. 7 and 8).

List of Reference Numbers

10 patch fastener device
12 plasterboard wall
14 first flat segment of 10
16 second flat segment of 10
18 third flat segment of 10
20 first securing facility of 10 on 14
22 rear surface of 24
24 plasterboard patch
26 second securing facility of 10 on 18
28 front surface of 12
30 cutout hole in 12
32 thin material of 10
34 first double sided adhesive tape for 20 on 14
36 first protective cover strip on 34
38 second double sided adhesive tape for 26 on 18
40 second protective cover strip on 38
42 small aperture in 14
44 plaster compound
46 small aperture in 18
48 rough texture on 14
50 rough texture on 18
52 irregular hole in 12
54 keyhole saw It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A patch fastener device for a plasterboard wall in preparation for plastering, comprising:

a) a plasterboard wall having an opening to be filled;

b) a plasterboard patch within said opening shaped and sized to fill said opening;

c) a sheet member of rigid material formed by stamping and bending for securing said patch within said opening comprising a first flat segment shaped in the form of a rectangle having first and second oppositely facing parallel bend lines, the distance between said bend lines being approximately the thickness of said plasterboard wall, a second flat segment extending from the first bend line of and at right angles to said first flat segment and lying flat against one side of said patch, and a third flat segment extending from the second bend line of said first flat segment and at right angles to said first flat segment in a direction opposite to that of said second flat segment and lying flat against a side of said wall opposite to that of said second flat segment, said wall and patch abutting opposite sides of said first flat segment;

d) means on the surface of said second flat segment facing said patch and means on the surface of said third flat segment facing said wall for securing said second and third flat segments to said patch and wall, respectively;

e) said securing means each comprising an adhesive layer with a peel off cover strip; and f) said second and third flat segments each having a plurality of spaced apertures for accommodating a plaster compound to be applied to cover said device.

* * * * *